US010941572B2

(12) United States Patent
Patki et al.

(10) Patent No.: US 10,941,572 B2
(45) Date of Patent: Mar. 9, 2021

(54) ROOF RIDGE OR HIP COVERING ELEMENT AND METHOD FOR MANUFACTURING A ROOF RIDGE OR HIP COVERING ELEMENT

(71) Applicant: Mohawk Carpet LLC, Calhoun, GA (US)

(72) Inventors: Rahul Patki, Richardson, TX (US); Raul Rodriguez, Dallas, TX (US); Claudio Caselli, Dallas, TX (US)

(73) Assignee: Daltile Corporation, Dallas, TX (US)

( * ) Notice: Subject to any disclaimer, the term of this patent is extended or adjusted under 35 U.S.C. 154(b) by 0 days.

(21) Appl. No.: 16/100,900

(22) Filed: Aug. 10, 2018

(65) Prior Publication Data

US 2020/0048909 A1 Feb. 13, 2020

(51) Int. Cl.
*E04B 7/02* (2006.01)
*E04D 1/30* (2006.01)

(52) U.S. Cl.
CPC ..... *E04D 1/30* (2013.01); *E04D 2001/305* (2013.01)

(58) Field of Classification Search
CPC ..... E04D 1/26; E04D 1/28; E04D 2001/305; E04D 5/00; B32B 5/30
See application file for complete search history.

(56) References Cited

U.S. PATENT DOCUMENTS 1,549,723 A 8/1925 Mattison
2,730,969 A 1/1956 Perry
4,888,932 A * 12/1989 Beare ..... E04D 1/30 52/748.1
5,365,711 A * 11/1994 Pressutti ..... E04D 1/26 264/131
5,685,931 A * 11/1997 Kakamu ..... B28B 1/002 156/304.2
6,125,602 A * 10/2000 Freiborg ..... E04D 1/265 52/198
6,351,913 B1 * 3/2002 Freiborg ..... E04D 1/30 52/276
8,371,072 B1 2/2013 Shanes et al.
2002/0000068 A1 * 1/2002 Freiborg ..... E04D 1/30 52/57
2002/0011043 A1 * 1/2002 Freshwater ..... E04D 1/30 52/518
2004/0055240 A1 * 3/2004 Kiik ..... A47G 27/0468 52/545

(Continued)

FOREIGN PATENT DOCUMENTS

EP 0117391 B1 4/1987
EP 2172600 A1 4/2010

(Continued)

OTHER PUBLICATIONS

International Search Report and Written Opinion for International (PCT) Application No. PCT/US2019/040218 dated Oct. 1, 2019.

(Continued)

*Primary Examiner* — Gisele D Ford
(74) *Attorney, Agent, or Firm* — Troutman Pepper Hamilton Sanders LLP; James E. Schutz; Chris N. Davis

(57) ABSTRACT

Disclosed herein is a roof ridge or hip covering element comprising a first and a second flat body and comprising a flexible sheet for joining together the first and second flat body.

8 Claims, 3 Drawing Sheets

(56) References Cited

U.S. PATENT DOCUMENTS

| | | | | |
|---|---|---|---|---|
| 2004/0128929 | A1 | 7/2004 | Moen | |
| 2004/0187434 | A1* | 9/2004 | Podirsky | E04D 1/30 52/748.1 |
| 2005/0284339 | A1 | 12/2005 | Brunton et al. | |
| 2007/0266665 | A1* | 11/2007 | Todd | E04D 1/20 52/518 |
| 2008/0078132 | A1 | 4/2008 | Jolitz | |
| 2008/0229695 | A1* | 9/2008 | Kalkanoglu | E04D 1/30 52/520 |
| 2009/0255202 | A1* | 10/2009 | Heidemann | E04F 15/02 52/388 |
| 2011/0185650 | A1* | 8/2011 | Kalkanoglu | E04D 1/20 52/173.3 |
| 2017/0037628 | A1* | 2/2017 | Rivard | E04D 1/30 |
| 2017/0218632 | A1* | 8/2017 | Patki | E04D 1/16 |
| 2018/0290421 | A1* | 10/2018 | Ide | B32B 5/30 |
| 2019/0177978 | A1* | 6/2019 | Grubka | B32B 11/10 |

FOREIGN PATENT DOCUMENTS

| | | | |
|---|---|---|---|
| GB | 2456008 | A | 7/2009 |
| WO | 2015092745 | A1 | 6/2015 |

OTHER PUBLICATIONS

International Search Report and Written Opinion for International (PCT) Application No. PCT/US2019/045455 dated Nov. 13, 2019.

* cited by examiner

ROOF RIDGE OR HIP COVERING ELEMENT AND METHOD FOR MANUFACTURING A ROOF RIDGE OR HIP COVERING ELEMENT

TECHNICAL FIELD

The present disclosure relates to a roof ridge or hip covering element and to a method for installing said roof tile. The disclosure further relates to a roof covering comprising roof ridge or hip covering element.

BACKGROUND

As it is known a roof can be formed by flaps or panels having different slopes that meet each other in couples in correspondence of a peak. If said peak is horizontal, it is called ridge, whereas if the peak is inclined, it is called hip. Said ridge and hip can be covered by rigid covering element, for example, made of metal, that can be properly shaped to be adapted to the slopes of the roof planes. Thus, the manufacturing of such covering elements can be complicated and expensive.

EP 0 117 391 B1 discloses a roof hip or ridge covering element comprising a bowed rigid body to be installed on a roof structure in correspondence of a ridge or hip of the roof. To adapt the covering element to the pitch of the roof, EP 0 117 391 B1 proposes to use a flexible strip that extends beyond the edges of the covering element. Anyway, said flexible strip is visible so that the aesthetic appearance of the roof is affected.

BRIEF DESCRIPTION OF THE DRAWINGS

With the intention of better showing the characteristics of the disclosure, in the following, as an example without any limitative character, several embodiments are described with reference to the accompanying drawings, wherein.

Figure 1:
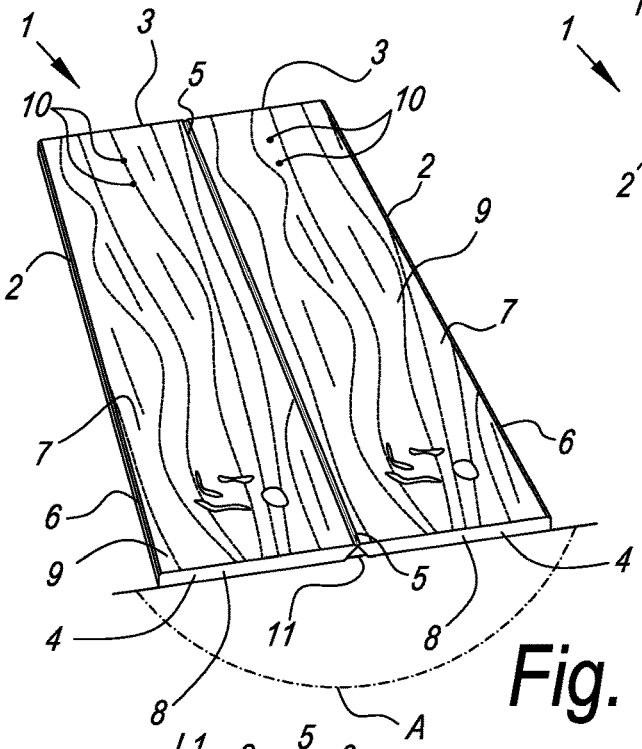
FIG. 1 represents a perspective view of a hip and ridge covering element according to the present disclosure in a first configuration.

Figures from 10A to 10E show some steps of a method for manufacturing a covering element.

DETAILED DESCRIPTION

The present disclosure aims in the first place at an alternative roof ridge or hip covering element, of the aforementioned type, whereby, according to various embodiments, solutions are offered for problems with roof tiles known in the art.

Thereto, the present disclosure, according to its first independent aspect, relates to a roof ridge or hip covering element comprising a first and a second flat body and comprising a flexible sheet for joining together the first and the second flat body. Thanks to this solution the angle between the two flat bodies may be regulated so that the covering element is adaptable to any roof pitch. Moreover, since the flexible sheet joins the flat bodies it may be hidden by said flat bodies to not being visible from outside. The angle between the flat bodies can be adjustable. For example, the flat bodies can be joined only by the flexible sheet. For example, the angle between the flat bodies can take any value between 0° and 360°, for example from 90° to 180°.

The flexible sheet may be in the form of a web, for example of a synthetic fiber or glass fiber. According to alternative embodiment the flexible sheet may be an impermeable sheet, for example of polyethylene or other polymeric material.

The flexible sheet is placed below the flat bodies so that it is hidden by the latter. In some embodiments, the flexible sheet is totally overlapped by the flat bodies. For example, the superficial dimension of the flexible sheet is equal or smaller to the sum of the superficial dimensions of the two flat bodies. For example, the width of the flexible sheet, measured when laying on a flat surface, can be smaller than the width of the covering element when laying on a flat surface. In some embodiments, the flexible sheet does not extend below the edges of the covering element so that it is not visible and does not adversely affect the aesthetic appearance of the roof covering, on the contrary since only the flat bodies are visible said aesthetic appearance is improved.

Within the meaning of the present application, with the term "length" of the covering element is intended that dimension that in use is substantially parallel to the direction of the hip or of the ridge on which the covering element is installed. Whereas with the term "width" of the covering element is intended that dimension that in use is substantially orthogonal to the direction of the hip or of the ridge on which the covering element is installed.

The flexible sheet is fixed to a lower surface of the first and second flat body. In particular, a first part of the flexible sheet can be fixed to the first flat body and a second part of the flexible sheet can be fixed to the second flat body. It is also noted that the flat bodies can be placed on a same face of the flexible sheet.

The flexible sheet is fixed to the flat bodies by means of a glue, for example epoxy glue, polyurethane glue or hot melt glue. According to an embodiment, the glue is provided in form of spots between the flexible sheet and the flat bodies, although it is not excluded that the glue is provided according to a pattern or in form of a uniform layer.

According to one embodiment, the flat bodies comprise substantially the same structural features, i.e. they may differ mainly for aesthetic features like color or décor.

The flat body can comprise a rectangular or trapezoidal shape. The flat body can comprise an upper and a lower edge, parallel to the width of the flat body, an inner edge adapted to be faced toward the other flat body of the covering element, and an external edge opposite to the other flat body. In some embodiments, the flat body comprises a trapezoidal shape having two opposite parallel edges (e.g., the upper and the lower edge), and two opposite and converging edges (e.g., the inner and the external edge). In some embodiments, the inner edge is orthogonal to the upper and the lower edge, whereas the external edge is inclined with respect of the parallel edges of an angle that is different form 90°. Moreover, in some embodiments, the converging edges converge each other toward the upper edge of the flat body, i.e., an edge that in use is adapted to be placed in an upper position with respect to the opposite edge, especially in case of a hip covering element. In other words, the upper edge can be shorter than the lower edge. It is noted that, in some embodiments, both of the flat bodies are trapezoidal so that, when lying on a flat plane the covering element has a trapezoidal shape that is tapered toward the upper edges of the flat bodies. This solution can be useful in case of hip or ridge covering elements that in use partially overlap each other. In fact, due to overlapping the flat portions of two adjacent covering element will not lie on the same plane but on parallel planes, and if the external edges would be orthogonal to the upper and lower edges, a step will be formed and visible between the external edges of the adjacent covering elements by means of said tapered shape, the external edges of overlapping covering element will provide an effect of a continuous edge thereby improving the aesthetic appearance of the roof covering.

The flat body can comprise at least one beveled edge (e.g., the inner edge). The beveled edge can be inclined with respect to an upper surface of the flat body of at least 30° (e.g., 35°, 40°, 45°, 50°, 55°, 60°, 65°, 70°, 75°, 80°). Said beveled edge can be inclined so that it comprises an upper end placed in a proximal position from the other flat body of the covering element, and a lower end that is placed in a distal position from the other flat body of the covering element. In practice, when the covering element lies on a flat plane, the beveled edges of the two flat bodies of the covering element converge each other toward the upper surfaces of the flat bodies, and can contact each other in correspondence of the upper surface. In this way, the angle between the flat bodies may be adjusted in such a way that the inner edges are never visible from a top view.

In some embodiments, the flat bodies are made of the same material and in particular are made of a ceramic material (e.g., porcelain). Porcelain can provide for a better frost and mechanical resistance with respect to other ceramic material. Moreover, porcelain can be cheaper than natural slate. Anyway, it is not excluded that the bodies are made of other materials like, for example, natural stone, natural slate, or metal.

In some embodiments, the flat body, i.e. first and/or second flat body, comprises a glaze coating that covers at least the upper surface of the flat body. Hereby, it is noted that the glaze coating is not necessarily situated directly above the ceramic body, however, this can be the case. The glaze coating contributes to the overall weather and frost resistance of the flat body, since water can mainly only be absorbed via the edges of the flat body itself. Another advantage is that the flat body, due to the presence of the glaze coating, may be provided with a variety of textures, designs, and colors. Other advantages that may be obtained by the presence of the glaze coating are the prevention or at least the minimization of moss growth, easy cleanability and/or UV-resistance.

Further, according to an embodiment, the glaze coating may cover at least one edge of the flat body, for example two or three edges of the flat body. In particular, since the covering elements are destined to be installed partially overlapping each other, there will be always one edge of each flat bodies (e.g., an upper edge) that in use will be placed below another covering element and that consequently will not be exposed to weather and water. On the contrary the other three edges will be exposed to weather and water. Providing a glaze coating on said exposed edges can improve the overall weather and frost resistance of the roof tile. In some embodiments, one or more of said exposed and glaze edges may be rounded or chamfered edges, for example they may be bullnose edges.

In an embodiment, the glaze coating comprises a glaze layer of uniform color, which, in case of said glaze coating comprising a print, is situated below said print. As advantage, the glaze layer of uniform color may hide imperfections in the upper surface of the ceramic body. Although the glaze layer of uniform color is in some embodiments of a white, black, beige or grey color, the glaze layer may be of another color as well. In the latter case, the advantage may be obtained that the ink lay-up, which is needed for obtaining the desired colors in the aforementioned print, can be lowered.

In some embodiments, the glaze coating comprises a transparent or translucent glaze layer, which, in case of said glaze coating comprising a print, can be arranged over said print. By having such glaze layer, the advantage may be obtained that the print can be protected from wear. Other advantages that may be obtained by the use of such transparent or translucent glaze layer are the minimization of moss growth, easy cleanability, and/or UV-resistance. It is noted that the aforementioned glaze coating may be a so-called wet or dry glaze.

In case the flat body is made of a material different from ceramic, the flat body may comprise one or more coating layers different from glaze, for example a lacquer.

In some embodiments, said glaze coating comprises a décor, which may simulate a natural product such as stone, natural slate or wood. In the latter case, the décor may show wood grains or wood nerves. As advantage, the flat body, and as a consequence the covering element, may have the look of a natural product such as natural slate or wood, while being provided with better weather and frost resistance than roof elements that are actually made of such materials. In a particular embodiment, said décor comprises a print. In other words, the décor, or at least part of the décor, can be provided by means of a printer or printing machine. Various techniques may be used to provide said print, such as screen printing, rotary serigraphy or digital printing. In case of digital printing, an inkjet printer may be used, which may be of the single pass type.

In case of the glaze coating being provided with a print, it can be advantageous that the ceramic body substantially matches the general color or appearance of that print. Indeed, in that way, any substantial contrast between the edges of the ceramic body and the print may be excluded. For accomplishing that goal, the ceramic body may be provided with one or more color pigments. The pigments may then be chosen such that they provide the ceramic body with a color or appearance that substantially matches the color or appearance of the front face of the roof tile. It is noted that, in general, the ceramic body may be provided with one or more color pigments, irrespective of the ceramic body substantially matching the color or appearance of décor of the flat body.

In some embodiments, the upper surface of the flat body is provided with a relief, which can be formed by a plurality of excavations present in said upper surface of the flat body. By the relief, the texture of the flat body, at the upper surface thereof, may simulate the texture of a natural product such as stone, natural slate or wood. In the latter case, the relief may for example simulate the texture of wood grains or wood pores.

The relief or at least part of the relief may also concern one or more chamfers present at the upper surface of the flat body, which may be provided at one or more edges of the flat body. For example, the relief or at least part thereof may concern a chamfered perimeter of the flat body, for example in the form of a bullnose edge. Various possibilities may be applied for providing the relief. In some embodiments, the relief is formed in the upper surface of the ceramic body, in which case the relief manifests itself through the glaze coating up to the upper surface of the flat body. Alternatively, the relief or at least part of the relief may be formed in the glaze coating, such that it is situated substantially or completely above the ceramic body. In case of said glaze coating being provided with a print, said relief may be performed "in register" with said print, which means that the relief is in alignment with the print. By having the relief "in register" with the print, the natural look or appearance of natural products such as wood or natural slate is better simulated. For example, in case the print is a wood pattern with lines simulating wood grains, the relief may be formed by lines following the course of said lines of the printed wood pattern or by a plurality of successive dashes having a configuration following the lines of the printed wood pattern.

For having the relief being performed "in register" with the print, the techniques known from WO 2015/092745 A1 may be used.

In some embodiments, the thickness of the flat body is located between 5 mm and 20 mm, and more in some embodiments between 7 mm and 15 mm (e.g., 8 mm, 9 mm, 10 mm, 11 mm, 12 mm, 13 mm, 14 mm). Such thickness provides a good balance between, on the one hand, the weight of the covering element, and, on the other hand, the strength of the covering element itself. For example, a thickness of about 12 mm can be beneficial for the hail impact rating of the covering element, and 12 mm is, in some embodiments, the thickness for covering elements destined to installations where hail impact resistance class 4 can be useful or required, whereas in installation wherein said hail impact resistance class 4 is not necessary 8 mm is, in some embodiments, a value for thickness to make a cheaper and lighter covering element.

The covering element is in some embodiments provided with at least one attachment hole. Such attachment hole is used to attach or fasten the covering element to a roof structure or framework of the roof, said framework for instance being formed by battens, or by a beam. The attachment hole is a through hole.

As advantage, the attachment hole allows a safe and secure installation of the covering element, for example by using nails, screws or wires. Moreover, the attachment hole allows a simple and efficient way to install the covering element.

In an embodiment, at least one attachment hole is present in at least one flat body of the covering element. For example, the attachment hole may be provided also in the flexible sheet, i.e. it may pass through the flexible sheet. According to some embodiments, each flat body of the covering element comprises at least one attachment hole, in some embodiments a plurality of attachment holes, for example two attachment holes. According to another embodiment, the attachment holes of said plurality are aligned orthogonal to the upper edge of the roof tile, i.e. substantially parallel to the direction of the hip or ridge.

The attachment hole is in some embodiments situated closer to the upper edge of the flat body than to the lower edge thereof. In some embodiments, the attachment hole is situated at a distance from the upper edge tile, as measured in the length direction of the flat body, which is smaller than 0.25 times the length of the flat body. As advantage, in the installed configuration, the attachment holes will be covered by an overlapping covering element.

According to an embodiment in case the flat bodies are made of ceramic or porcelain, the attachment hole comprises a first enlarged portion and a second narrow portion, wherein the first enlarged portion is disposed close to the upper surface of the covering element. The first enlarged portion and the second narrow portion being coaxially each other. In this way, the enlarged portion defines a seat for the nail head and at the same time defines a guide for an ejecting nozzle of a nail gun so that the nail can be properly positioned and directed into the hole minimizing the risk of damaging the flat body.

It is noted that the feature that the angle between the flat bodies is adjustable forms an inventive concept from the flexible sheet. Therefore, according to its second independent aspect, the disclosure provides for a roof ridge or hip covering element comprising a first and a second flat body and comprising a connecting element for joining together said first and a second flat body and wherein said connecting element is configured for adjusting an angle between said first and a second flat body. Therefore, the flexible sheet represents, in some embodiments, the connecting element. Other examples for said connecting element, may be an elastomeric strip connecting the inner side of the flat bodies, or hinges connecting the flat bodies. It is noted that the covering element of said second independent aspect may comprise one or more of the features described in relation to the first independent aspect.

It is also noted that, a third independent aspect of the disclosure provides for a roof covering comprising a plurality of roof hip or ridge covering element, wherein each of said covering element comprises one or more of the features described above in relation to the first and second independent aspects.

In some embodiments said roof covering may comprise a plurality of roof tiles for covering the roof flaps of the roof. In this case, said roof tiles can comprise a ceramic body, for example made of porcelain, and optionally a glaze coating. In this case the roof tile may comprise one or more of the features described in the application WO 2017/132431.

The roof covering may also comprise an under layer disposed beneath the covering element. The under layer may provide additional functionalities to the covering element. As advantage, it may be tailored, irrespective of the properties of the material of the flat bodies. In some embodiments, said under layer is made of a material different from ceramic or porcelain. In particular, said under layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said layer, low-density polyethylene or LDPE is used in some embodiments, although the use of high-density polyethylene or HDPE is not excluded. In this way the under layer is placed below the joints between the covering element, for example between the inner edges of the flat bodies of a same covering element, thereby improving impermeability of the roof covering.

A fourth independent aspect of the disclosure provides for a method for manufacturing a roof hip or ridge covering element, for example comprising one or more of the features described above in relation to the first and second independent aspects. The method comprises the step of: providing a first and a second flat body, providing a connecting element, for example a flexible sheet, and joining together said flat bodies via said connecting element thereby providing the roof ridge or hip covering element.

Said step of joining together said flat bodies via said flexible sheet, in some embodiments comprises a step of gluing the flexible sheet to the first and second flat body. For example, the glue may be epoxy glue, polyurethane glue or, in some embodiments, hot melt glue. According to an embodiment of the disclosure, the glue is provided in form of spots between the flexible sheet and the flat bodies, although it is not excluded that the glue is provided according to a pattern or in form of a uniform layer.

Said step of joining together the flat bodes may further comprise a step of pressing or laminating together said flat bodies and said flexible sheet, for example heat laminating.

According to some embodiments wherein the covering element, and in particular the flat bodies, is made of ceramic, in some embodiments porcelain, the step of providing flat bodies may comprise the steps of: providing a ceramic composition, in some embodiments in powder form; forming, in some embodiments pressing, said ceramic composition for forming a flat semi-product; and/or firing the flat semi-product to obtain a flat body. The method may also comprise a step of providing the glaze coating, in some embodiments onto the upper surface of said flat semi-product before said step of firing. Said step of providing the glaze coating in some embodiments comprises also the step of providing the décor, in some embodiments printing, or in some embodiments, digital printing via an ink jet printer.

The step of providing said flat bodies may be conducted in several possibilities, two of which are described here below.

According to the first possibility, the step of providing the first and second flat body, may comprise the step of manufacturing each of the first and second flat body independently, i.e. as a single piece. According to said embodiment the method may comprise the step of providing a rectangular flat semi-product and the step of cutting said rectangular flat semi-product thereby obtaining a trapezoidal flat body, for example cutting along a cutting line that is inclined to the inner edge to form the external edge. In case the flat body is made of ceramic or porcelain said cutting step is performed after firing. This can be advantageous in case the covering element is made of ceramic, and in particularly in case it is made of porcelain. In fact, since porcelain is a highly vitrified ceramic material, during the firing step it can be subjected to an important shrinkage, i.e. to a reduction of dimension. This shrinkage may be different on each edge of the porcelain body and therefore it is complicated to control the final dimension of the porcelain body. This is further enhanced in case of trapezoidal and generally non-rectangular or non-squared shapes. By manufacturing one rectangular porcelain flat semi-product and subsequently cutting the flat bodies it is easier to obtain a final product with the proper dimensions.

According to the second possibility the step of providing the first and second flat body, may comprise the steps of: providing a rectangular flat semi-product, cutting said flat piece thereby obtaining the first and a second flat body. According to an embodiment of said second possibility, the flat piece is rectangular and said step of cutting comprises a first cutting step for cutting the rectangular flat piece along a substantial median cutting line to obtain two rectangular flat portions, and a second cutting step for cutting each rectangular flat portion thereby obtaining two trapezoidal flat bodies. Said second cutting step is substantially the same described in the first possibility. Moreover, the first and second cutting step may be inverted. It is also possible that the flat piece is trapezoidal and that the cutting step comprises only the first cutting step of cutting along the median cutting line.

Said flat piece, manufactured according to the second possibility may comprise a front face decorated with multiple images representing the décors of a plurality of flat body, for example the décors of the two flat bodies of the covering element. This can be particularly useful in case of a covering element made of porcelain so that the porcelain body of the flat piece is fired together with the glaze coating and the décor. These multiple images may be provided by respectively printing in certain areas of the upper surface of the flat piece. These images may be separated from each other by means of intermediate lines, transitions or edges, which are not necessarily provided by means of printing, although this is not excluded. In such front face, the borders or transitions between adjacent images may be represented by means of a relief. For example, as previously described, these borders or transitions may be formed by means of depressions in the upper surface of the flat piece, situated between the images of flat bodies. Thank to this solution it is possible to manufacture several flat bodies starting from one ceramic object thereby simplifying the ceramic process. Moreover, it is possible to manufacture one ceramic object, namely the flat semi-product and then tailoring the flat bodies according to the needs. For example, the flat bodies may be cut according to the desired shapes and dimensions.

It is noted that, said step of providing the first and second flat body may comprise the step of machining an edge of said flat body, in particular the inner edge of said flat body, for providing said beveled edge. In case the flat bodies are made of ceramic material, said machining is in some embodiments done after firing. Anyway, it is not excluded that said beveled edge is provided before firing of the ceramic material, for example during the pressing step.

The step of providing the first and second flat body may also comprise the step of providing the attachment hole into said flat body. Said attachment hole may be drilled into the flat body. In some embodiments, wherein the flat body is made of ceramic, in some embodiments porcelain, the attachment hole is in some embodiments provided into the flat body before a step of firing. For example, the attachment hole is provided into the flat body at the time of pressing a ceramic composition into a mold. In fact, fired ceramic materials, and in particular porcelain, are hard materials so that drilling can be an expensive and complex process.

Discussing now the figures and embodiment(s) depicted therein, FIG. 1 represents a perspective view of a roof hip and ridge covering element 1 according to the present disclosure, with a view on the front face of the covering element 1 in a flat configuration.

The covering element 1 comprise a first and a second flat body 2. Each of the flat bodies 2 comprise a trapezoidal shape. It has an upper surface 3 and a lower surface 4, whereby, in the installed condition of the covering element 1, especially in case of a hip covering (see FIG. 9), the upper surface 3 is directed upwards, whereas the lower surface 4 is directed downwards. The flat body 2 further comprise an inner edge 5 facing the other flat body 2 and an external edge 6 opposite with respect to the other flat body 2.

The upper surface 7 forms the decorative surface of the flat body 2.

Each flat body 2 comprises a ceramic body 8, which is made of porcelain, and a glaze coating 9, which is situated above said ceramic body 8. The glaze coating 9 comprises a décor, which here simulates wood, for example showing wood nerves and wood pores.

Each flat body 2 is provided with at least one attachment hole 10. Here, the flat bodies 2 are provided with a plurality of attachment holes 10. The attachment holes 10 are present in at least the ceramic body 8 of the flat bodies 2. They are situated closer to the upper edge 3 of the flat body 2 than to the lower edge 4 thereof.

The covering element 1 further comprises a flexible sheet 11 joining together the two flat bodies 2 disposed below said flexible bodies 2. The flexible sheet 11 is configured to for adjusting an intermediate angle A between said first and a second flat body 2.

The angle intermediate A between the flat bodies 2 can take any value between 0° and 360°, for example between 90° and 180°. In FIG. 1 is shown the covering element in a flat configuration wherein said angle A is of 180°.

Figure 2:
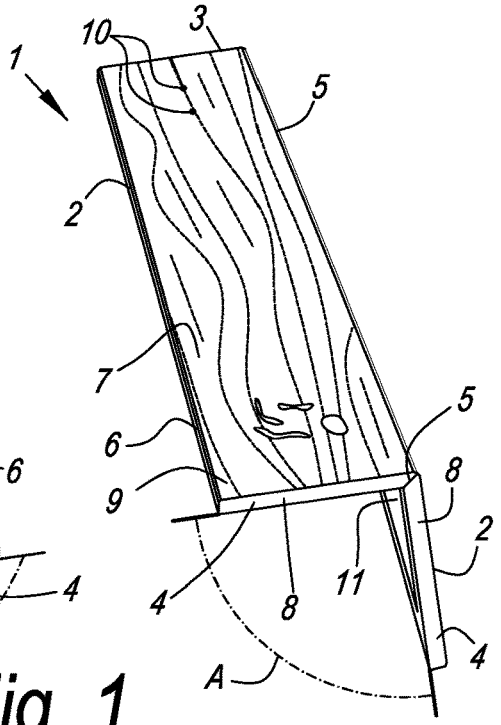
FIG. 2 represents a perspective view of the covering element of FIG. 1 in a second configuration.

FIG. 2 represents a perspective view of the covering element of FIG. 1 in a second configuration wherein the intermediate angle A is of 90°.

Figure 3:
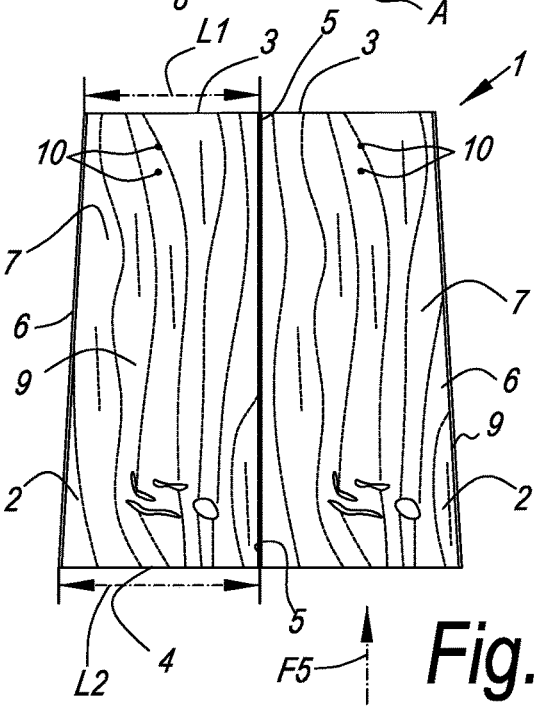
FIG. 3 represents top plane view of the covering element of FIG. 1.

FIG. 3 represents top plane view of the covering element of FIG. 1.

The inner edge 5, of each flat body 2 is substantially orthogonal to the upper edge 3 and the lower edge 4. In FIG. 3 is shown a configuration wherein the inner edges 5 of the flat bodies 2 are in contact each other, although it is not excluded that, according to alternative embodiments, the inner edges 5 are distanced each other, i.e. not in contact.

The external edge 6, of each flat body 2, is inclined relative to the upper edge 3 and the lower edge 4 of an angle different from 90°. In some embodiments, the upper edge 3 has a length L1 that is lower to the length L2 of the lower edge 4.

Figure 4:
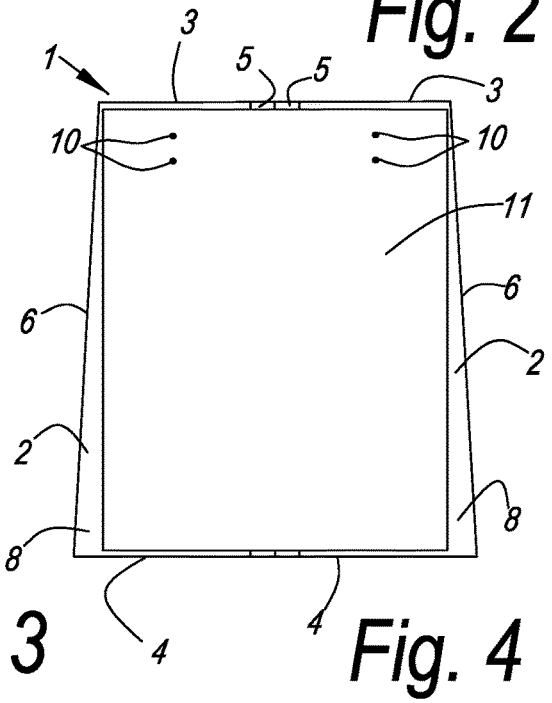
FIG. 4 represents bottom plane view of the covering element of FIG. 1.

FIG. 4 represents a bottom view of the covering element of FIG. 1.

The flexible sheet 11 is placed below the flat bodies 2, for example it is totally overlapped by the flat bodies 2.

According to some embodiments, the flexible sheet 11 may be in form of a web, for example of a synthetic fiber or glass fiber. According to alternative embodiment the flexible sheet 11 may be an impermeable sheet, for example of polyethylene or other polymeric material.

As visible from FIG. 4 the attachment holes 10 are through hole that passes through holes that pass the entire thickness flat bodies 2 and even pass through the flexible sheet 11.

Figure 5:
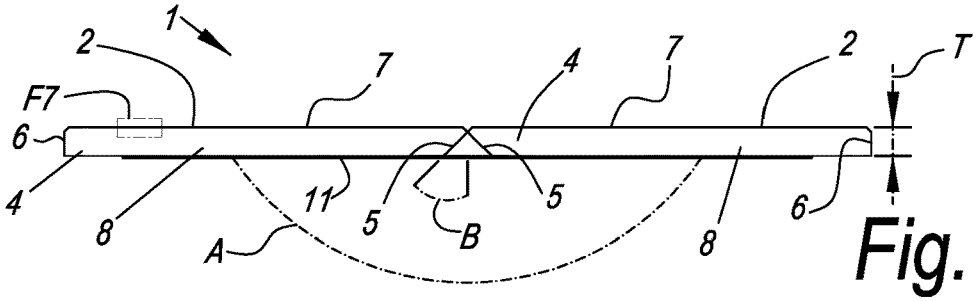
FIG. 5 shows an enlarged view according the direction F5 of FIG. 3.

FIG. 5 shows an enlarged view according the direction F5 of FIG. 3.

Each flat body 2 comprises a beveled inner edge 5 facing the other flat body 2. The inner edge 5 is inclined with respect to the upper surface 7 of the flat body 2 of a beveling angle B of at least 30°, in some embodiments 45°. As shown in FIG. 5, when the covering element 1 lies on a flat plane, i.e. the intermediate angle A is 180°, the inner edges 5 of the two flat bodies 2 of the covering element 1 converge each other toward the upper surfaces 7 of the flat bodies 2, and in some embodiments contacts each other in correspondence of the upper surface 7.

The thickness T of the flat body 2 is in some embodiments located between 5 and 20 mm, more in some embodiments between 7 and 15 mm, and still more in some embodiments the thickness T is approximately 8 mm or 12 mm. In some embodiments, 12 mm is thickness T for covering elements 1 destined to installation wherein a hail impact resistance class 4 is useful or required, whereas in installation wherein said hail impact resistance class 4 is not required 8 mm is an exemplary value for thickness T to make a cheaper and lighter covering element 1.

Figure 6:
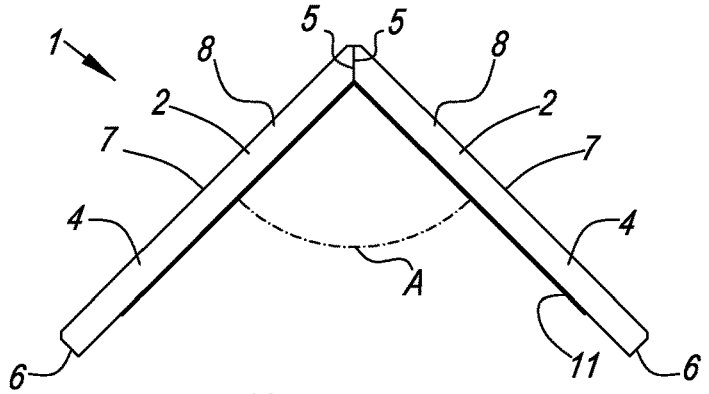
FIG. 6 represents the view of FIG. 5 with the covering element in a second configuration.

FIG. 6 represents the view of FIG. 5 with the covering element 1 in a configuration wherein the intermediate angle A is 90°. As can be seen from this FIG. 6 such configuration is permitted by the flexible sheet 11 and also by the beveled inner edges 5.

Figure 7:
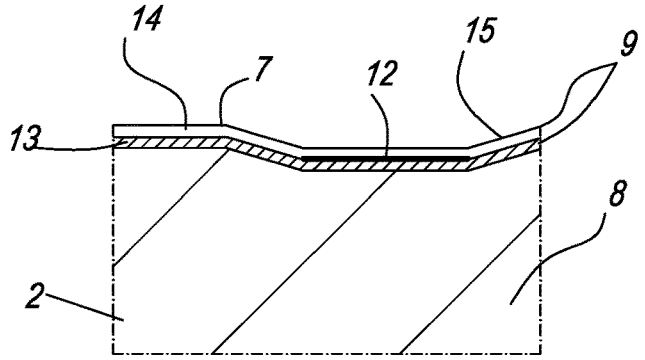
FIG. 7 represents an enlarged view of the section that is indicated with F6 in FIG. 5.

FIG. 7 represents an enlarged view of the section that is indicated with F6 in FIG. 5.

The glaze coating 9 comprises a décor, said décor comprising a print 12, a glaze layer 13 of uniform color, which is situated below the print 12, and a transparent or translucent glaze layer 14, which is arranged over said print 12. It is noted that according to alternative examples the glaze coating 9 may be free from said transparent or translucent glaze layer 14 and/or from said print 12.

The upper surface 7 of the flat body 2 is provided with a relief 15, which, in the represented example, is formed by a plurality of excavations present in said upper surface 7. According to the present embodiment the relief 15 is formed in the ceramic body 8 and manifest itself through the glaze coating 9, although according to non-showed embodiments the relief 15 may be at least partially formed directly in the glaze coating 9.

Figure 8:
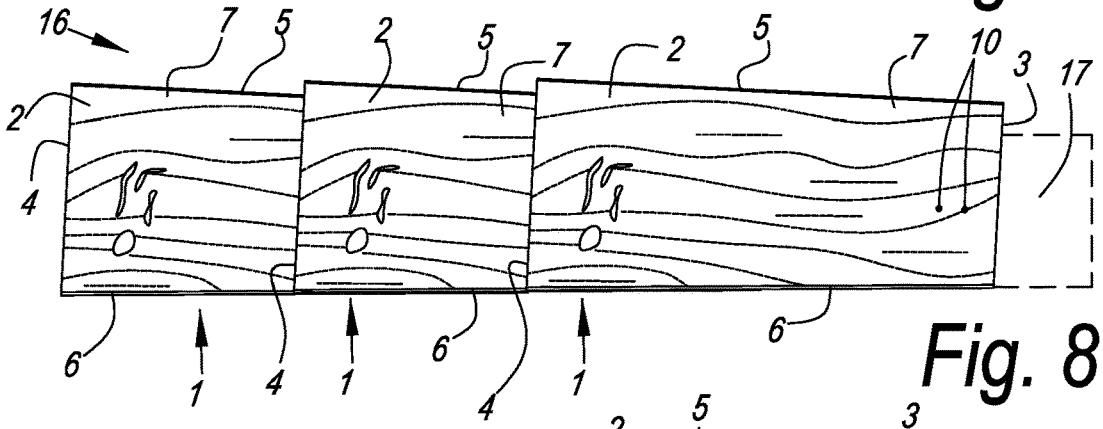
FIG. 8 represents a side view of a roof ridge covering according to the disclosure.

FIG. 8 represents a side view of a roof ridge covering 16 comprising a plurality of covering elements 1 as described above. The covering elements 1 are installed above a roof structure or a roof frame 17. The covering elements 1 are attached or fastened to roof frame 17 by means of nails or screws which are put in the attachment holes 10

The covering elements 1 are in a bent configuration wherein the intermediate angle A is lower than 180°, for example is 90° as shown in FIGS. 2 and 6. The covering elements 1 are partially overlapped each other to improve impermeability of the roof covering. In this overlapped configuration each covering element 1 covers and hides the attachment holes 10 of the covering element 1 below. It is noted that the covering elements 1 are overlapped so that the lower edge 4 is visible and the upper edge 3 is placed below and overlapping covering element 1.

It is noted that thanks to the trapezoidal shape of the flat bodies 2, in this overlapped configuration the external edges 6 of the overlapping covering 1 elements are substantially parallel sot to give the impression of a unique edge of the roof ridge covering 16.

Figure 9:
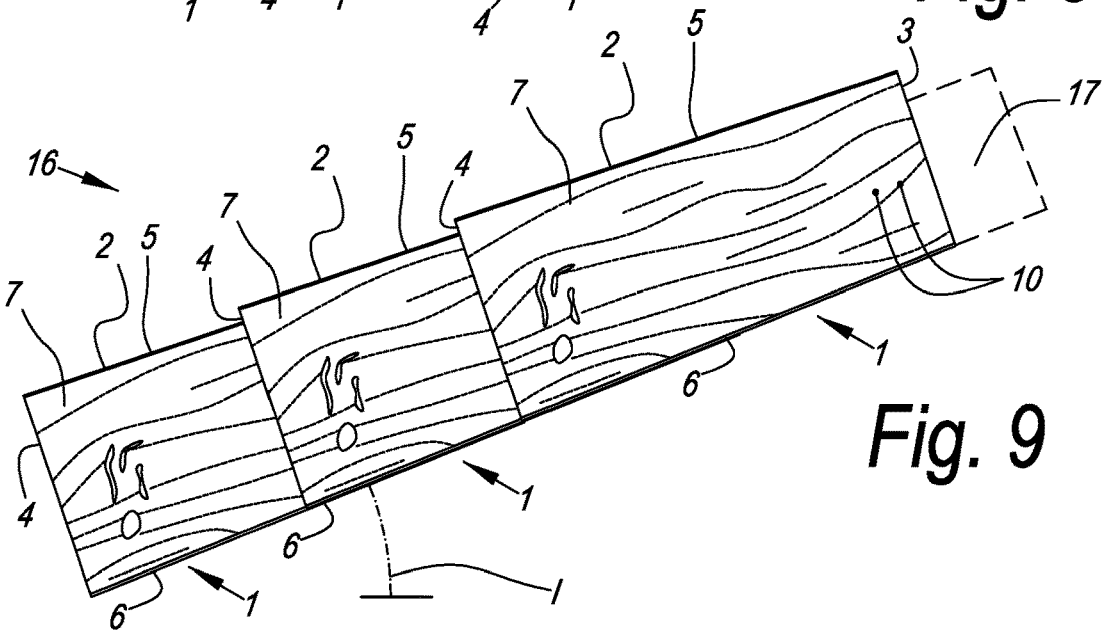
FIG. 9 represents a side view of a roof hip covering according to the disclosure.

FIG. 9 represents a side view of a roof hip covering according to the disclosure.

In FIG. 9, I denotes the inclination of the roof hip, for example of the roof structure 17 with respect to the horizontal. It is noted that the covering elements 1 are overlapped so that the lower edge 4 is visible and the upper edge 3 is placed below and overlapping covering element 1. Also, in this case, it is noted that thanks to the trapezoidal shape of the flat bodies 2, in this overlapped configuration the external edges 6 of the overlapping covering 1 elements are substantially parallel sot to give the impression of a unique edge of the roof ridge covering 16.

Figures from 10A to 10E show some steps of a method for manufacturing the covering element 1.

Figure 10A:
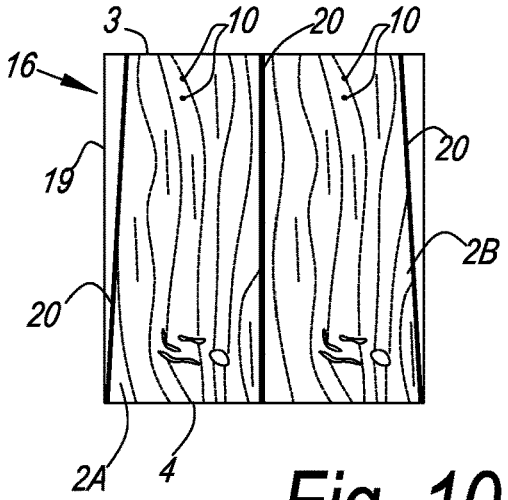

FIG. 10A shows a first step of providing a rectangular flat semi-product 18. The rectangular flat semi-product 18 comprises a fired porcelain body 19 and is provided with the glaze coating 9 on the upper surface 7.

In the represented example, the front face of the rectangular flat semi-product 18 represents or forms an image of a plurality of trapezoidal flat bodies 2A, 2B. The borders of, or the transition between, the images of the trapezoidal flat bodies 2A, 2B are formed by depressions 20.

Although, in the represented example, the front face of the rectangular flat semi-product 18 represents or forms an image of two trapezoidal flat bodies 2A, 2B, it is not excluded that less or more than two trapezoidal bodies 2A, 2B are represented. It is also not excluded that the front face of the rectangular flat semi-product 18 represents a rectangular flat body 2A, 2B instead of a trapezoidal flat body 2A, 2B.

According to some embodiments, the attachment holes 10 are provided in the rectangular flat semi-product 18 before firing of the porcelain body 19. Any it is not excluded the method comprise a step of providing said attachment holes 10 after firing.

Figure 10B:
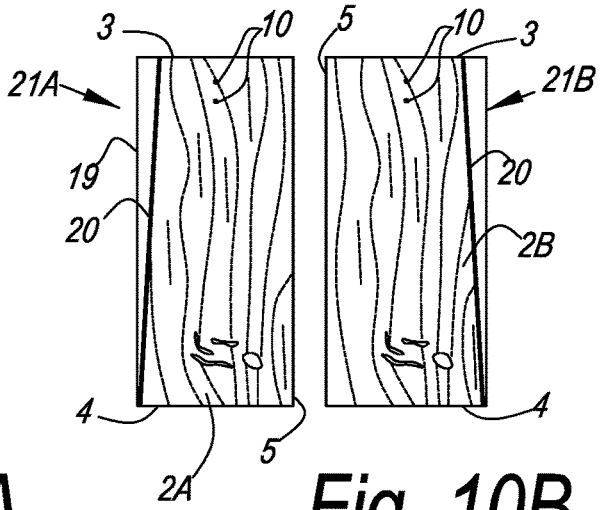

FIG. 10B shows a second step of cutting the rectangular flat semi-product 18 along a median cutting line, for example substantially coinciding with one depression 20, thereby providing two rectangular half-processed flat bodies 21A, 21B. By cutting along the depression 20 the inner edges 5 are formed.

Each of the half-processed flat bodies 21A, 21B comprises, on its front face one image of trapezoidal flat bodies 2A or 2B.

Figure 10C:
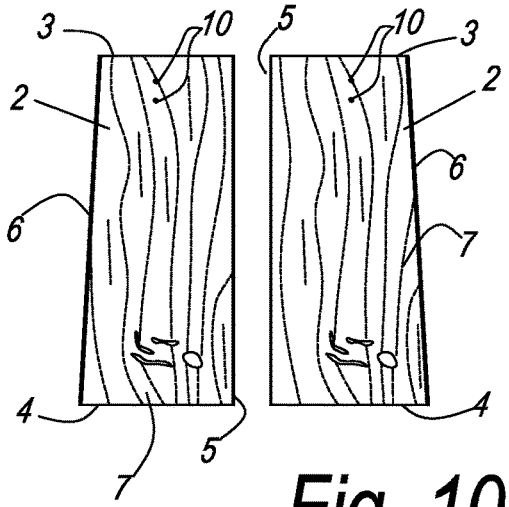

FIG. 10C shows a second step of cutting the half-processed flat bodies 21A, 21B along a cutting line that are inclined to the inner edge 5 to form the external edges 6, and thereby providing the trapezoidal flat bodies 2. Said inclined cutting line are coinciding with depressions 20.

Figure 10D:
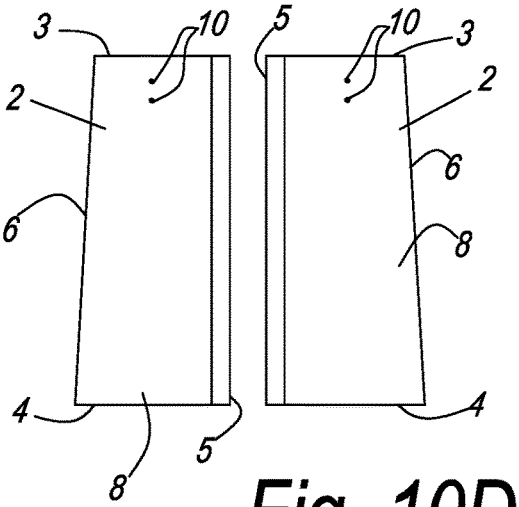

FIG. 10D shows a step of machining the inner edges 5 of each flat body 2 for forming the beveled edge. Said step of machining may be conducted either before or after, or even contemporarily to the step of forming the external edges 6 shown in FIG. 10C, as well as contemporarily to the step of cutting the rectangular flat semi-product 18 for forming the inner edges 5, shown in FIG. 10B.

Figure 10E:
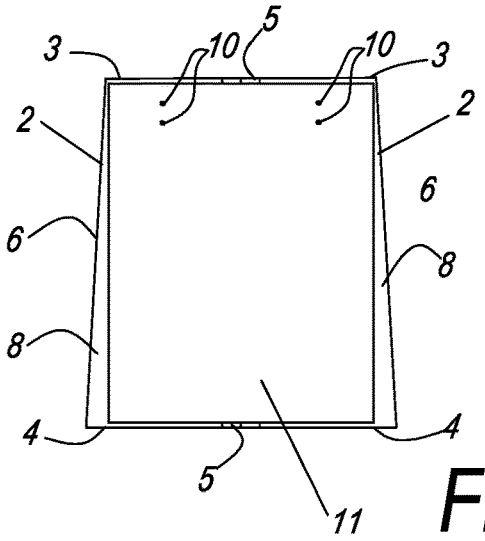

FIG. 10E shows a step of the method wherein the flat bodies 2 are joined together by the flexible sheet 11. During said step of joining the flexible sheet 11 is fixed to the lower surfaces of the ceramic bodies 8.

The flexible sheet 11 and the ceramic bodies 8 may be laminated or press laminated together, for example by means of glue such as epoxy glue or hot melt glue.

The present disclosure is in no way limited to the hereinabove described embodiments, but such system may be realized according to different variants without leaving the scope of the present disclosure.

Further, as is clear from the content of the description, the present disclosure relates to one or more of the items as listed below, numbered from 1 to 20:

1. A roof ridge or hip covering element comprising a first and a second flat body and comprising a flexible sheet for joining together the first and second flat body.

2. The roof ridge or hip covering element of item 1, wherein said flexible sheet comprises a fiberglass web.

3. The roof ridge or hip covering element according to any of the preceding items, wherein said flexible sheet is fixed to the lower surface of the first and second flat bodies.

4. The roof ridge or hip covering element according to any of the preceding items, wherein each of said first and second flat bodies comprise a beveled edge facing the other flat body.

5. The roof ridge or hip covering element according to any of the preceding items, wherein said beveled edge is inclined with respect to an upper surface of the flat body of at least 30°, in some embodiments 45°.

6. The roof ridge or hip covering element according to any of the preceding items, wherein said first and second flat bodies are made of a ceramic material, in some embodiments porcelain.

7. The roof ridge or hip covering element of item 6, wherein said first and second flat bodies comprise a glazed upper surface.

8. The roof ridge or hip covering element according to any of the preceding items, wherein said first and second flat bodies comprise a décor on the upper surface, in some embodiments imitating a natural stone, slate or wood.

9. The roof ridge or hip covering element according to any of the preceding items, wherein each of said flat bodies comprises at least an attachment hole, in some embodiments two attachment holes.

10. The roof ridge or hip covering element according to any of the preceding items, wherein each of said flat bodies has a trapezoidal shape.

11. A roof covering comprising a roof ridge or hip covering element according to any of the preceding items.

12. A method for manufacturing a roof ridge or hip covering element comprising the steps of: providing a flat piece, cutting said flat piece thereby obtaining the a first and a second flat body;

providing a flexible sheet and joining together said flat bodies via said flexible sheet thereby providing the roof ridge or hip covering element.

13. The method according to item 12, wherein said flat piece comprise ceramic body, and wherein said cutting is performed after firing of said ceramic body.

14. The method according to item 13, comprising the step of providing at least an attachment hole into said flat piece before firing.

15. The method according to any one of the item from 12 to 14, comprising the step of providing at least an attachment hole into said flat bodies.

16. The method according to any one of the item from 12 to 15, comprising the step of machining at least one edge of said flat bodies.

17. The method according to any one of the item from 12 to 16, wherein said flat piece comprises an upper surface provide with a décor representing the first and the second flat body separated by a transition line, and wherein said cutting is performed along said transition line.

18. The method according to item 17, wherein said transition line is made in form of an excavation on the upper surface of the flat piece.

19. The method according to any one of the item from 12 to 18, wherein said step of joining comprises the step of gluing the flexible sheet to the first and second portion.

20. A roof ridge or hip covering element comprising a first and a second flat body and comprising a connecting element for joining together said first and a second flat body and wherein said connecting element is configured for adjusting an angle between said first and a second flat body.

We claim:

1. A roof ridge or hip covering element comprising:

a first flat body;

a second flat body; and a flexible sheet for joining together the first flat body and second flat body, wherein each of the first flat body and second flat body comprise a top surface and a beveled edge facing the other flat body, wherein the beveled edges converge toward the top surfaces of the first flat body and the second flat body, wherein the flexible sheet is fixed to a lower surface of the first and second flat bodies, wherein the first and second flat bodies comprise a ceramic material, wherein the beveled edges contact one another at an upper portion of the beveled edges in use, wherein each of the first and second flat bodies comprises at least one attachment hole, and wherein the attachment hole is configured to attach the first and second flat bodies to the roof ridge or hip.

2. The roof ridge or hip covering element of claim 1, wherein said flexible sheet comprises a fiberglass web.

3. The roof ridge or hip covering element of claim 1, wherein said beveled edge is inclined with respect to an upper surface of the flat body of at least 30°.

4. The roof ridge or hip covering element of claim 1, wherein said first and second flat bodies comprise a glazed upper surface.

5. The roof ridge or hip covering element of claim 1, wherein said first and second flat bodies comprise a décor on an upper surface.

6. The roof ridge or hip covering element of claim 1, wherein each of said flat bodies has a trapezoidal shape.

7. A roof covering comprising a roof ridge or hip covering element according to claim 1.

8. A roof ridge or hip covering element comprising:

a first flat body;

a second flat body; and a connecting element for joining together the first flat body and the second flat body, wherein the connecting element is configured for adjusting an angle between the first flat body and the second flat body, wherein each of the first flat body and second flat body comprise a top surface and a beveled edge facing the other flat body, wherein the beveled edges converge toward the top surfaces of the first flat body and the second flat body, wherein the connecting element is fixed to a lower surface of the first and second flat bodies, wherein the first and second flat bodies comprise a ceramic material, wherein the beveled edges contact one another at an upper portion of the beveled edges in use;

wherein each of the first and second flat bodies comprises at least one attachment hole, and wherein the attachment hole is configured to attach the first and second flat bodies to the roof ridge or hip.

* * * * *